US008998009B2

(12) United States Patent
Kim et al.

(10) Patent No.: US 8,998,009 B2
(45) Date of Patent: Apr. 7, 2015

(54) WALL ASSEMBLY FOR GOODS DISPLAY

(71) Applicants: Paul Sung Kim, Duluth, GA (US); Kwang Suk Ko, Duluth, GA (US)

(72) Inventors: Paul Sung Kim, Duluth, GA (US); Kwang Suk Ko, Duluth, GA (US)

( * ) Notice: Subject to any disclaimer, the term of this patent is extended or adjusted under 35 U.S.C. 154(b) by 0 days.

(21) Appl. No.: 14/071,971

(22) Filed: Nov. 5, 2013

(65) Prior Publication Data

US 2014/0183150 A1 Jul. 3, 2014

(30) Foreign Application Priority Data

Dec. 4, 2012 (KR) ..... 10-2013-0139837

(51) Int. Cl.

| | |
|---|---|
| ***A47F 5/00*** | (2006.01) |
| ***A47F 5/08*** | (2006.01) |
| ***A47B 43/00*** | (2006.01) |
| ***A47B 47/00*** | (2006.01) |
| ***A47B 57/00*** | (2006.01) |
| ***A47F 5/10*** | (2006.01) |
| ***A47B 96/06*** | (2006.01) |
| ***A47B 96/07*** | (2006.01) |
| ***A47B 95/00*** | (2006.01) |
| ***A47B 96/14*** | (2006.01) |

(52) U.S. Cl.

CPC ..... *A47F 5/08* (2013.01); *A47F 5/0846* (2013.01); *A47F 5/103* (2013.01); *A47B 96/067* (2013.01); *A47B 96/07* (2013.01); *A47B 95/008* (2013.01); *A47B 96/1416* (2013.01); *A47B 2096/1491* (2013.01)

(58) Field of Classification Search

CPC ..... E04B 2002/7483; E04B 2/7437; A47B 96/06; A47B 96/061; A47B 96/068; A47B 96/07; A47B 96/025; A47B 96/028; A47B 96/14; A47B 96/1416; A47B 2096/1491; A47B 95/008; A47B 57/30; A47B 57/32; A47B 57/34; A47B 57/00; A47B 57/42; A47B 57/56; A47B 57/562; A47B 55/00; A47B 53/00; A47F 5/0807; A47F 5/083; A47F 5/0846; A47F 5/01; A47F 5/101; A47F 5/103; A47F 5/08

USPC ..... 211/106.01, 193, 90.01, 87.01, 94.01, 211/189, 103, 175; 248/235, 247, 250; 52/36.4–36.6

See application file for complete search history.

(56) References Cited

U.S. PATENT DOCUMENTS

| | | | | | |
|---|---|---|---|---|---|
| 4,018,019 | A | * | 4/1977 | Raith et al. | 52/239 |
| 4,224,769 | A | * | 9/1980 | Ball et al. | 52/36.1 |
| 4,817,538 | A | * | 4/1989 | Michaelsen | 108/108 |
| 4,884,375 | A | * | 12/1989 | Wendt | 52/36.6 |
| 5,495,952 | A | * | 3/1996 | Kainz | 211/90.04 |

(Continued)

*Primary Examiner* — Jennifer E Novosad

(74) *Attorney, Agent, or Firm* — East West Law Group; Heedong Chae

(57) ABSTRACT

Provided is a wall assembly for goods display constituted by horizontal tracks fixed to a wall body and disposed in a lateral direction at equal intervals, vertical posts disposed on the horizontal tracks and disposed in a vertical direction at equal intervals, an interval adjustment unit configured to couple the vertical post with respect to the horizontal track to adjust an interval, an insert member inserted into the vertical post in the vertical direction, and an outer panel coupled to the vertical post. Accordingly, even when flatness of the wall body is bad, the wall assembly can be instructed and the flatness of the panel after construction can be appropriately maintained so that an appearance of a wall surface can be excellently finished. In addition, since removal and exchange of only a damaged panel are easy when the outer panel is damaged, construction and exchange can be easily performed.

8 Claims, 17 Drawing Sheets

(56) References Cited

U.S. PATENT DOCUMENTS

| | | | | |
|---|---|---|---|---|
| 5,695,078 | A * | 12/1997 | Otema | 211/103 |
| 6,047,508 | A * | 4/2000 | Goodman et al. | 52/241 |
| 6,167,664 | B1 * | 1/2001 | Reuter et al. | 52/239 |
| 6,279,761 | B1 * | 8/2001 | Niewiadomski et al. | 211/94.01 |
| 6,481,678 | B1 * | 11/2002 | Chong | 248/220.42 |
| 6,711,871 | B2 * | 3/2004 | Beirise et al. | 52/782.1 |
| 7,407,060 | B2 * | 8/2008 | Swartz et al. | 211/94.01 |
| 7,861,986 | B2 * | 1/2011 | Cline | 248/201 |
| 2001/0029707 | A1 * | 10/2001 | Hsueh | 52/36.4 |
| 2003/0192842 | A1 * | 10/2003 | Suttles | 211/87.01 |
| 2006/0175274 | A1 * | 8/2006 | Yang | 211/94.01 |
| 2007/0056921 | A1 * | 3/2007 | Lo | 211/94.01 |
| 2010/0096347 | A1 * | 4/2010 | Theobald et al. | 211/85.7 |
| 2012/0018602 | A1 * | 1/2012 | Cattaneo | 248/222.11 |
| 2014/0183150 | A1 * | 7/2014 | Kim et al. | 211/90.01 |

* cited by examiner

WALL ASSEMBLY FOR GOODS DISPLAY

CROSS-REFERENCE TO RELATED APPLICATION

This application claims priority to and the benefit of Korean Patent Application No. 2012-0139837, filed on Dec. 4, 2012, the disclosure of which is incorporated herein by reference in its entirety.

BACKGROUND

1. Field of the Invention

The present invention relates to an assembly for displaying goods on an interior wall section of a store or the like, and more particularly, to a wall assembly for goods display capable of being easily constructed as a facility for displaying goods on an inner wall of a store and easily moved and installed in another place.

2. Discussion of Related Art

In general, goods for sale are displayed on an inner wall of a store in various types such that consumers can easily see the goods. That is, display equipment is required to be variously varied according to types of goods. However, deformation of display equipment into various types according to the kind of goods is inefficient and very wasteful.

Accordingly, in recent times, a wall assembly for goods display in which a frame is installed at a wall body and separate unit panels are attached to the frame has been developed.

As an example, Korean Patent Registration No. 10-0499790 discloses a wall holder type goods display apparatus constituted by a holder member having an attachment section having an outer diameter substantially equal to an inner diameter of an installation hole formed in a panel, a plurality of anti-rotation protrusions formed at an outer circumferential surface of the attachment section and fitted into the inner circumferential surface of the installation hole, an adhesion section formed at a front surface of the attachment section to be adhered to a front surface of the panel, and insertion holes passing through centers of the attachment section and the adhesion section; and a display member constituted by a holder having a support section separately inserted into the insertion hole of the holder member and hooked to a rear surface of the panel disposed over a rear surface of the attachment section, and a support bar connected to a connecting section of the holder to display goods.

However, in the conventional art having the above-mentioned configuration, while each element may be easily exchanged with a new one, since partial exchange is impossible when the panel is damaged, the entire panel should be exchanged, which decreases workability.

In addition, Korean Utility Model Registration No. 20-0192675 discloses a wall-attached goods display mechanism constituted by a fixing member having an attachment section attached to a wall surface by a screw, an upper hooking piece vertically extending from an inclined section of an upper end of the attachment section, and a lower hooking piece protruding from a lower end of the attachment section, which are integrally formed; and a hooking member having upper and lower arc-shaped bodies configured to form one hooking groove into which various hanger members are hooked, upper and lower settling pieces formed at ends of the upper and lower arc-shaped bodies to be fastened to upper and lower hooking pieces of the fixing member, and a rear surface section configured to connect the upper and lower arc-shaped bodies at a rear surface side of the hooking groove.

However, in the conventional art having the above-mentioned configuration, the hooking member is directly connected to the fixing member fixed to the wall body and a hook is hooked thereon. Accordingly, the wall body is directly exposed to the outside, which damages an appearance of the display, and painting or pretreatment construction should be separately performed on the wall body. In addition, since the goods are independently positioned, the goods cannot be easily arranged upon display.

Further, Korean Patent Application Laid-Open No. 10-2008-0092743 discloses a wall surface finishing system including a coupling channel having a protrusion coupler formed with a coupling surface extending in a vertical direction and in contact with a wall surface to be coupled to the wall surface, and protruding from a side end of the coupling surface toward a front surface of the wall surface and extending in a lateral direction; and a panel formed in a planar shape having side ends parallel to the coupling channel in a vertical direction and including a panel coupler coupled to only a rear surface of a side end and disposed inside the side end to be coupled to a protrusion coupler of the coupling channel.

However, in the conventional art, flatness of the panel surface after finishing cannot be secured, workability may be decreased, and an exchange operation may be delayed. That is, construction is performed by coupling the panel to the coupling channel. Accordingly, since the coupling channel is directly assembled to the wall body by a screw, when the wall body is uneven, flatness of the panels fixed thereto is also degraded, which degrades the appearance after finishing. In particular, since the panel is assembled to the coupling channel by a screw, when partial exchange is needed, a separation operation may be delayed and the entire workability may be decreased.

Meanwhile, as another example of the conventional art, Korean Patent Application Laid-Open No. 10-2011-054943 discloses a remodeling panel assembly structure of inner and outer wall surfaces of a building including reinforcement frames fixed to the inner and outer wall surfaces of the building by a fixing member at predetermined intervals in a lattice pattern; an assembly block fixed to the reinforcement frame by a fixing member and having pluralities of insertion protrusions and insertion grooves, which enable mutual insertion and coupling; a connecting frame fixed between the assembly block and the reinforcement frame; and a mesh member coupled to the connecting frame and configured to cover an exposed space to prevent exposure of the inner and outer wall surfaces of the building, which occurs between the assembly blocks when the assembly blocks are fixed to the reinforcement frames.

However, since the conventional panel assembly having the above-mentioned structure has no countermeasures with respect to the case in which the flatness of the wall body is bad, construction of the panels may be impossible or a state after finishing may be largely degraded according to a state of the wall body. When the construction should be inevitably performed, since planarization of the wall body should be primarily performed, a working time and amount may be further increased.

SUMMARY OF THE INVENTION

In consideration of the above-mentioned problems, an aspect of the present invention is to provide a wall assembly with which a facility needed for goods display can be easily constructed and removed.

Another aspect of the present invention is to provide a wall assembly for goods display that can be constructed even when flatness of a wall body is bad, and that appropriately maintains flatness of the panel after construction to provide a good appearance.

Still another aspect of the present invention is to provide a wall assembly for goods display in which a panel can be easily exchanged with a new one when the panel is damaged.

According to an aspect of the present invention, there is provided a wall assembly for goods display constituted by horizontal tracks fixed to a wall body and disposed in a lateral direction at equal intervals, vertical posts disposed on the horizontal tracks and disposed in a vertical direction at equal intervals, an interval adjustment unit configured to couple the vertical post with respect to the horizontal track to adjust an interval, an insert member inserted into the vertical post in the vertical direction, and an outer panel coupled to the vertical post.

A middle post may be further installed at an intermediate position between the vertical posts. As the middle post is installed, deformation such as bending or the like of an intermediate section of the outer panel can be prevented.

A height adjustment backing member may be installed at lower ends of the vertical post and the middle post. A height of the posts can be adjusted by the backing member to appropriately maintain a horizontal state.

A support frame having both ends fixed to the vertical post and the middle post and configured to define an interval between the vertical post and the middle post may be installed. The support frame can securely support an interval between the vertical post and the middle post.

The interval adjustment unit may be constituted by a post fastening member having an inner pipe provided with one side fixed to a rear surface of the vertical post and the other side extending rearward, a track fastening member having an outer pipe provided with one side fixed to the horizontal track and the other side coupled to the inner pipe to be length-adjustable, and a fixing bolt fastened to the outer pipe and configured to restrict mutual movement of the inner pipe and the outer pipe at a selected position. Since a height of the vertical post from the wall surface can be appropriately adjusted by the interval adjustment unit, the flatness of the outer panel mounted on the vertical post can be appropriately maintained.

The post fastening member may constitute a fastening section formed in substantially a C shape at a tip thereof and may be fixed to a coupling section formed along the entire length of the vertical post by a screw.

The track fastening member may configure a hook formed at a rear end and may be fixed to an arbitrary position on a hooking groove formed along the entire length of the horizontal track.

The vertical post may be constituted by a coupling section having a rectangular cross-section disposed in the vertical direction and an open front side, flanges extending from open ends of the coupling section toward both sides, side support walls extending forward from inner side ends of the flanges, a shelf installation gap formed between the side support walls at a predetermined interval, and a support wall protruding from the coupling section to provide a space with the flanges to form an insertion section.

The insert member may have a plurality of shelf hooking slots formed in a longitudinal direction and may be inserted into a fastening hole of the vertical post in the longitudinal direction to be fixed by a screw.

A slat wall insert may be fixed to a lower end of the outer panel in the lateral direction by a screw.

A hooking screw may be fixed to a rear surface of the outer panel, a plurality of fastening holes may be formed in the flange of the vertical post in the longitudinal direction, and a head section of the hooking screw may be hooked to the fastening hole so that the outer panel is coupled to the vertical post.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

Hereinafter, a configuration of an exemplary embodiment of a wall surface finishing assembly according to the present invention will be described in detail with reference to the accompanying drawings.

Figure 1:
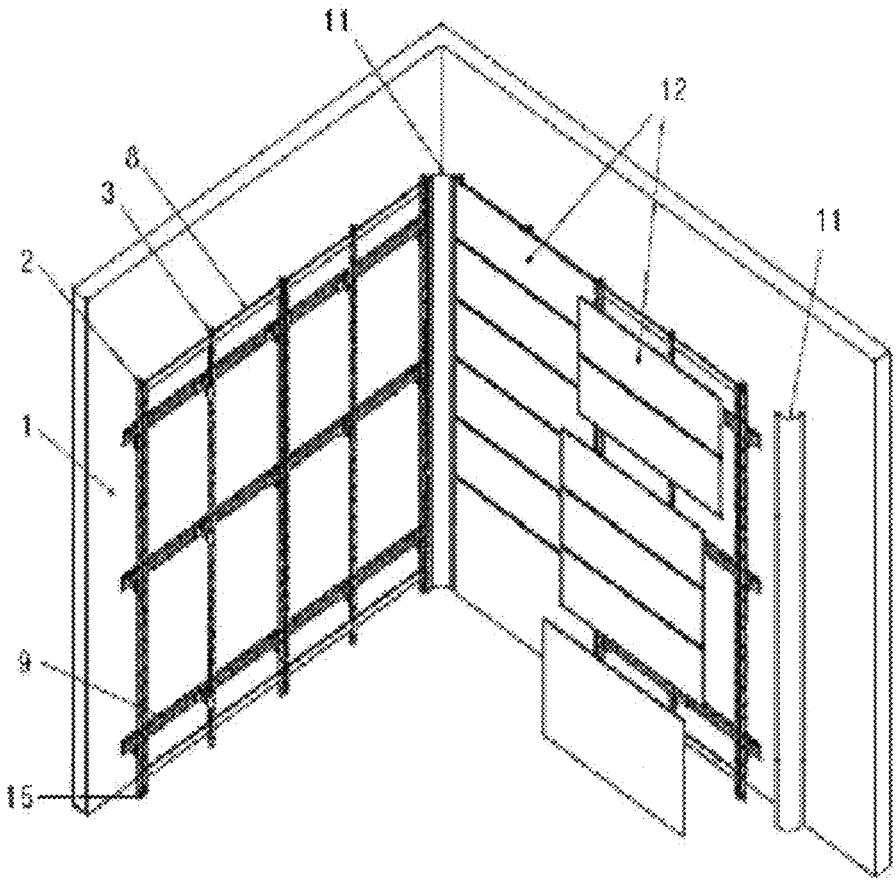
FIG. 1 is a perspective view showing the entire configuration of a wall surface finishing assembly according to the present invention.
Figure 2:
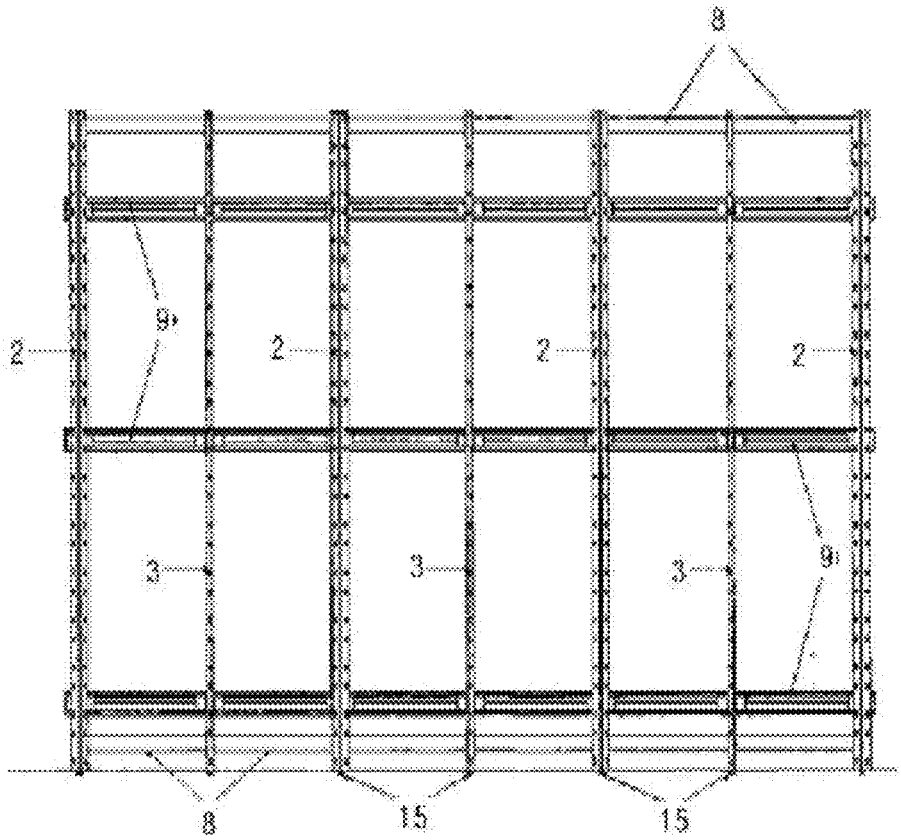
FIG. 2 is a front view of the entire configuration of the wall surface finishing assembly according to the present invention, showing a state before an outer panel is installed.

FIG. 1 is a perspective view of the entire configuration of the wall surface finishing assembly according to the present invention, showing a state in which some of outer panels 12 are separated. FIG. 2 is a front view showing a configuration of a horizontal track 9 and a vertical post 2 in a state in which the outer panel 12 is not installed. Here, the assembly of the present invention is disposed on a wall body 1 in a lateral direction, and a plurality of horizontal tracks 9 are installed in a vertical direction at predetermined intervals. Vertical posts 2 are disposed in front of the horizontal track 9 in the vertical direction and installed in a lateral direction at predetermined intervals. An interval adjustment unit is installed between the vertical post 2 and the horizontal track 9 to adjust an interval between the two members.

A middle post 3 is further installed at an intermediate position between the neighboring vertical posts 2.

Both ends of a support frame 8 are fixed between the vertical post 2 and the middle post 3 to stably maintain an interval between the vertical post 2 and the middle post 3.

Figure 3:
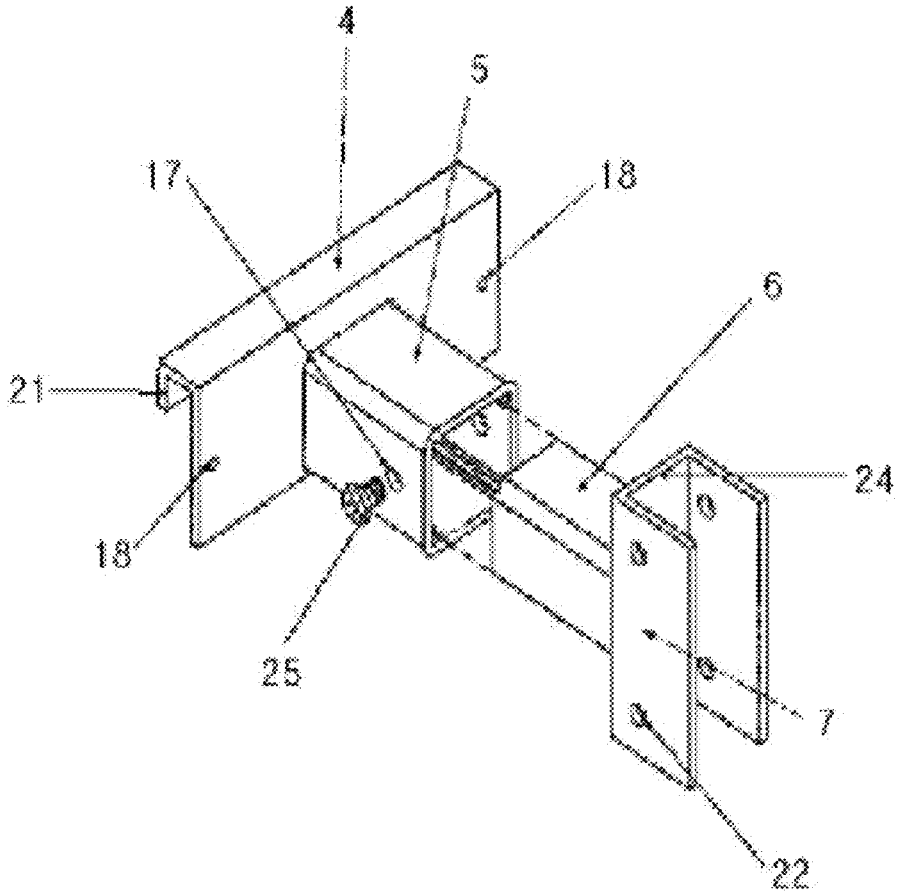
FIG. 3 is an exploded perspective view showing a configuration of an interval adjustment unit of the wall surface finishing assembly according to the present invention.
Figure 4:
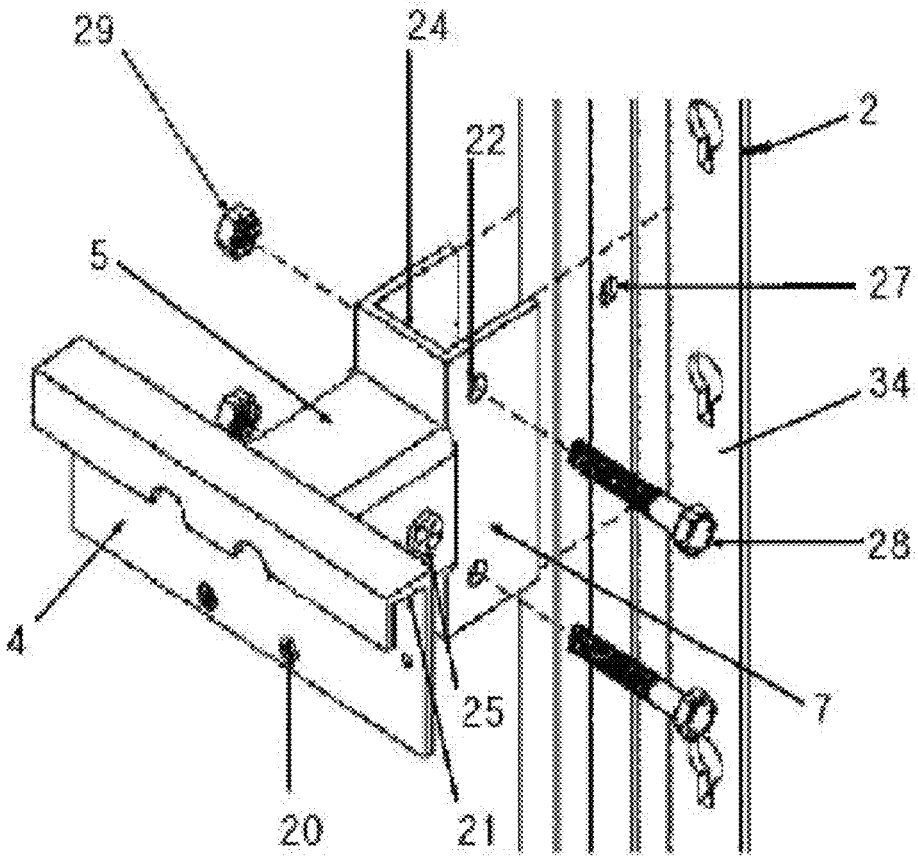
FIG. 4 is an assembled perspective view of the interval adjustment unit of the wall surface finishing assembly according to the present invention.

FIG. 3 is a perspective view showing a state in which components of the interval adjustment unit are separated, and FIG. 4 is a perspective view showing a state in which the components of the interval adjustment unit are coupled. Here, the interval adjustment unit includes a post fastening member 7 having an inner pipe 6 provided with one side fixed to a rear surface of the vertical post 2 and the other side extending rearward. In addition, the interval adjustment unit includes a track fastening member 4 having an outer pipe 5 provided with one side fixed to the horizontal track 9 and the other side coupled to the inner pipe 6 to be adjustable in length. A fastening hole 18 into which the horizontal track 9 is coupled is formed in the track fastening member 4. A screw hole 17 is formed in the outer pipe 5, a fixing bolt 25 is coupled to the screw hole 17, and a tip of the fixing bolt 25 presses an outer surface of the inner pipe 6 inserted into the outer pipe 5 to limit mutual movement of the inner pipe 6 and the outer pipe 5 at a selected position.

FIG. 4 shows a coupling structure of the post fastening member 7. The post fastening member 7 has a fastening section 24 formed in substantially a C shape at a tip thereof, and is fixed by a bolt 28 and a nut 29 passing through a fastening hole 27 of the vertical post 2 and a fastening hole 22 of the fastening section 24. The outer pipe 5 and the track fastening member 4 are fixed by a screw 20.

Figure 5:
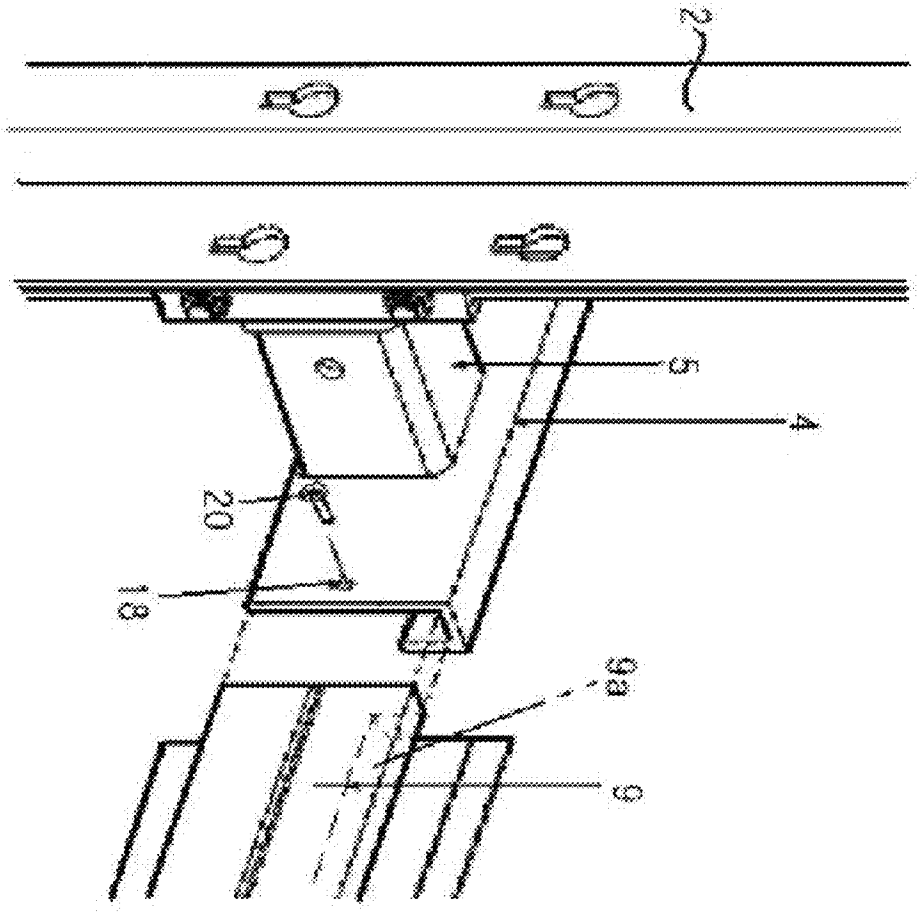
FIG. 5 is an exploded perspective view showing a coupling configuration of a horizontal track and the interval adjustment unit of the wall surface finishing assembly according to the present invention.
Figure 6:
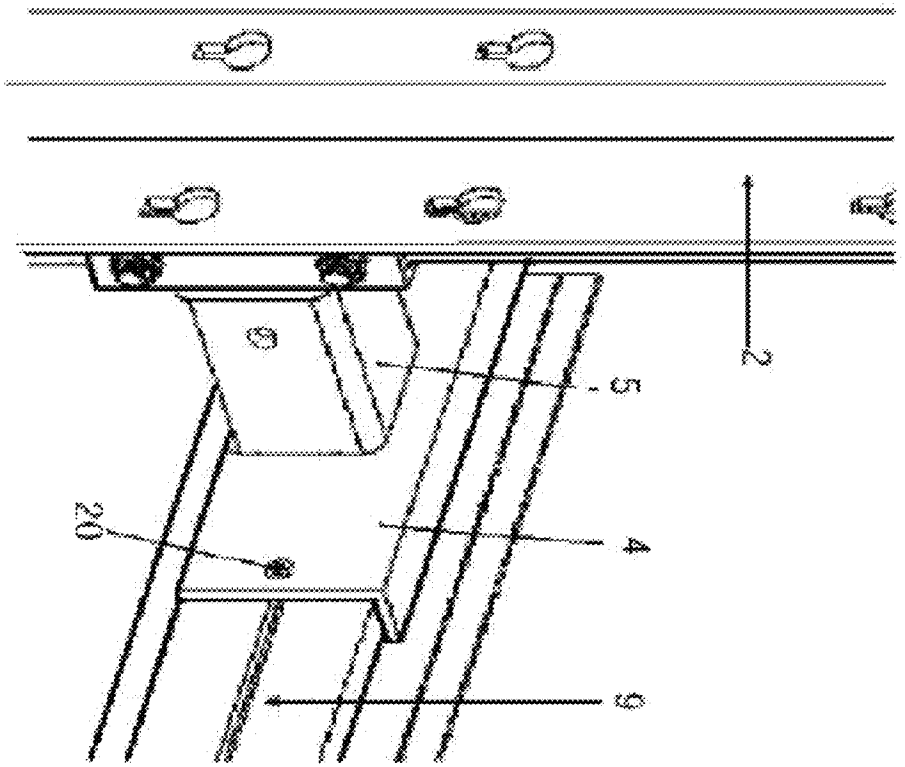
FIG. 6 is a perspective view showing a coupled state of the horizontal track and the interval adjustment unit of the wall surface finishing assembly according to the present invention.

FIG. 5 shows a state before a coupling structure of the track fastening member 4 and the horizontal track 9 is coupled, and FIG. 6 is a perspective view showing a state in which the track fastening member 4 and the horizontal track 9 are coupled. The track fastening member 4 has a hook 21 formed at a rear end thereof, and is fixed by the screw 20 coupled to the fastening hole 18 as shown in FIG. 6 at an arbitrary position on a hooking groove 9*a* formed along the entire length of the horizontal track 9.

Figure 7:
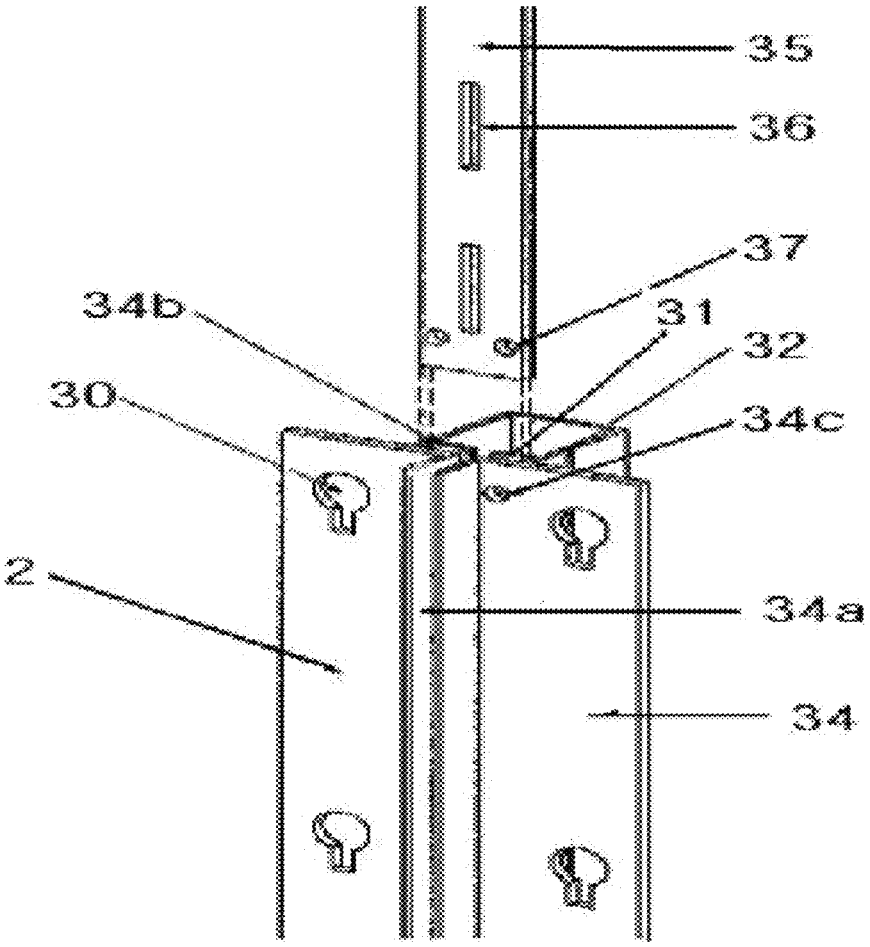
FIG. 7 is an exploded perspective view showing a configuration of a vertical post and an insert member of the wall surface finishing assembly according to the present invention.

According to the present invention, as shown in FIG. 7, an insert member 35 inserted into the vertical post 2 in the vertical direction is provided.

Figure 8:
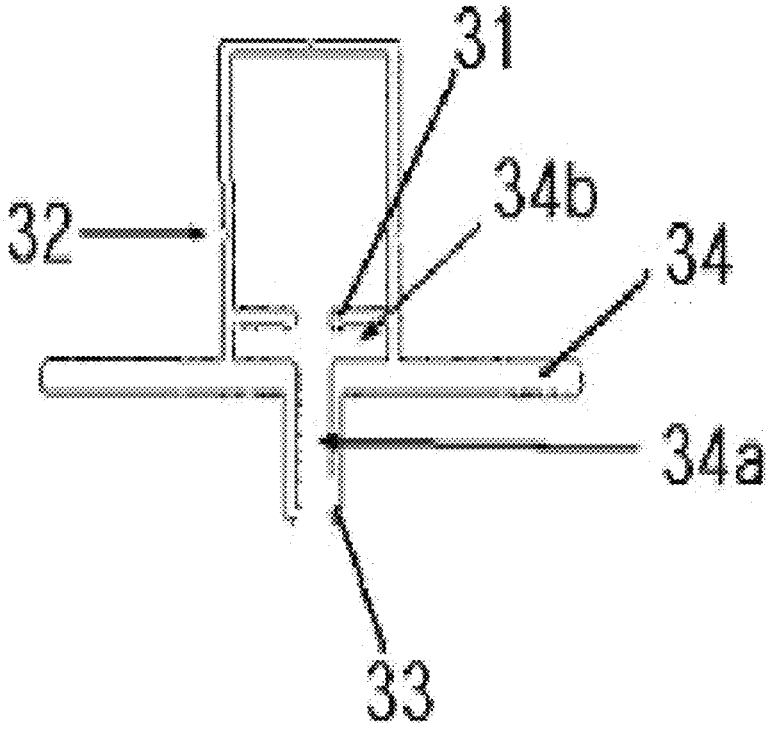
FIG. 8 is a lateral cross-sectional view showing the configuration of the vertical post of the wall surface finishing assembly according to the present invention.

As shown in FIG. 8, the vertical post 2 includes a coupling section 32 having a rectangular cross-section disposed in the vertical direction and an open front side, flanges 34 extending from an open end of the coupling section toward both sides, side support walls 33 extending forward from inner side ends of the flange 34, a shelf hooking gap 34*a* formed between the side support wall 33 to provide a predetermined interval, and a support wall 31 protruding from the coupling section 32 and configured to provide a space with the flange 34 to form an insertion section 34*b*, which are integrally formed with each other.

In addition, the insert member 35 is inserted into the insertion section 34*b* formed by the support wall 31, a plurality of shelf hooking slots 36 are formed in a longitudinal direction, and fastening holes 37 formed in both ends are fixed by a screw with a fastening hole 34*c* of the vertical post 2.

Figure 9:
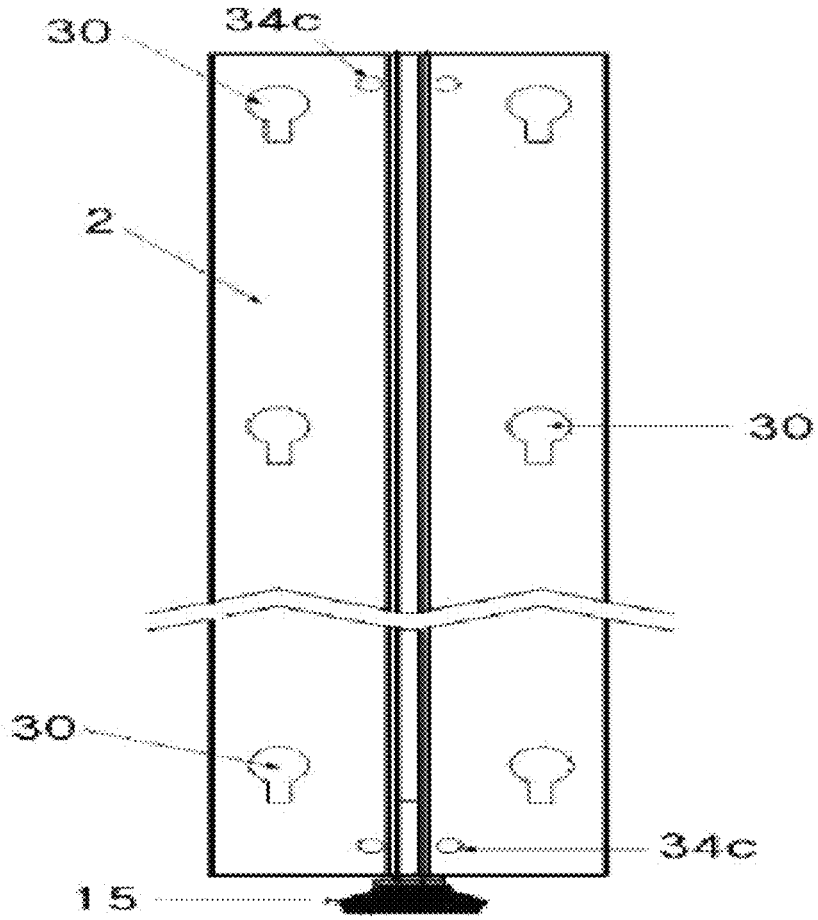
FIG. 9 is a front view showing the configuration of the vertical post of the wall surface finishing assembly according to the present invention.

Meanwhile, as shown in FIG. 9, a height adjustment backing member 15 may be installed at lower ends of the vertical post 2 and the middle post 3. The height adjustment backing member 15 is configured to control a height of the post through rotation using a conventional technique generally with which a partition or the like is generally provided, detailed description of which will be omitted.

Figure 10:
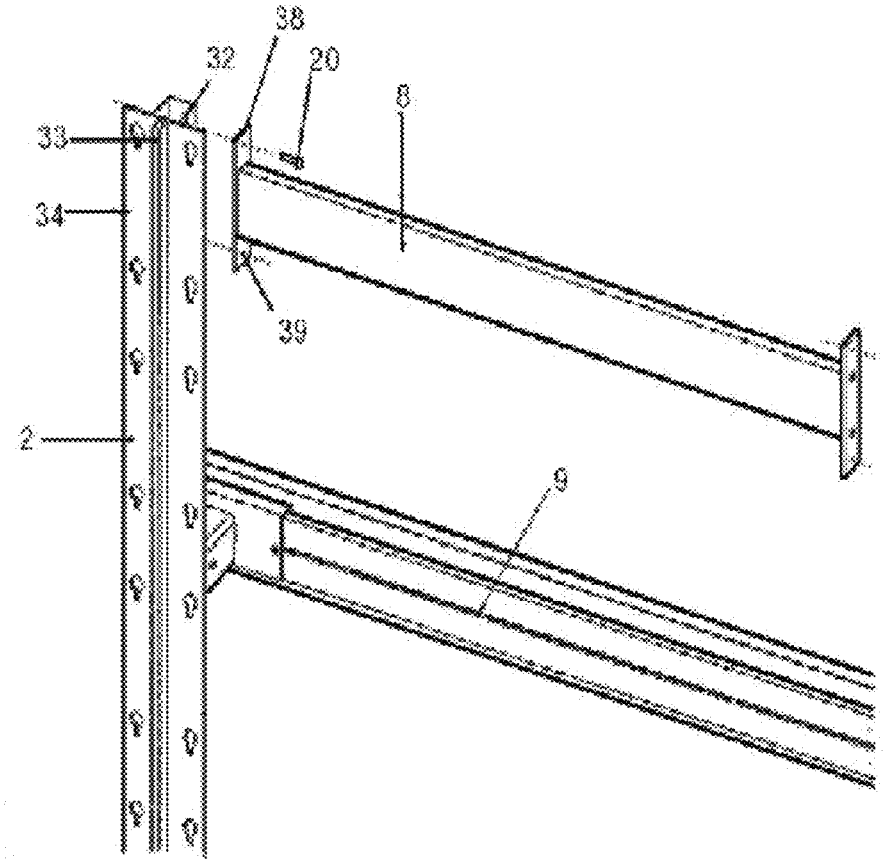
FIG. 10 is an exploded perspective view showing a coupling configuration of a support frame of the wall surface finishing assembly according to the present invention.
Figure 11:
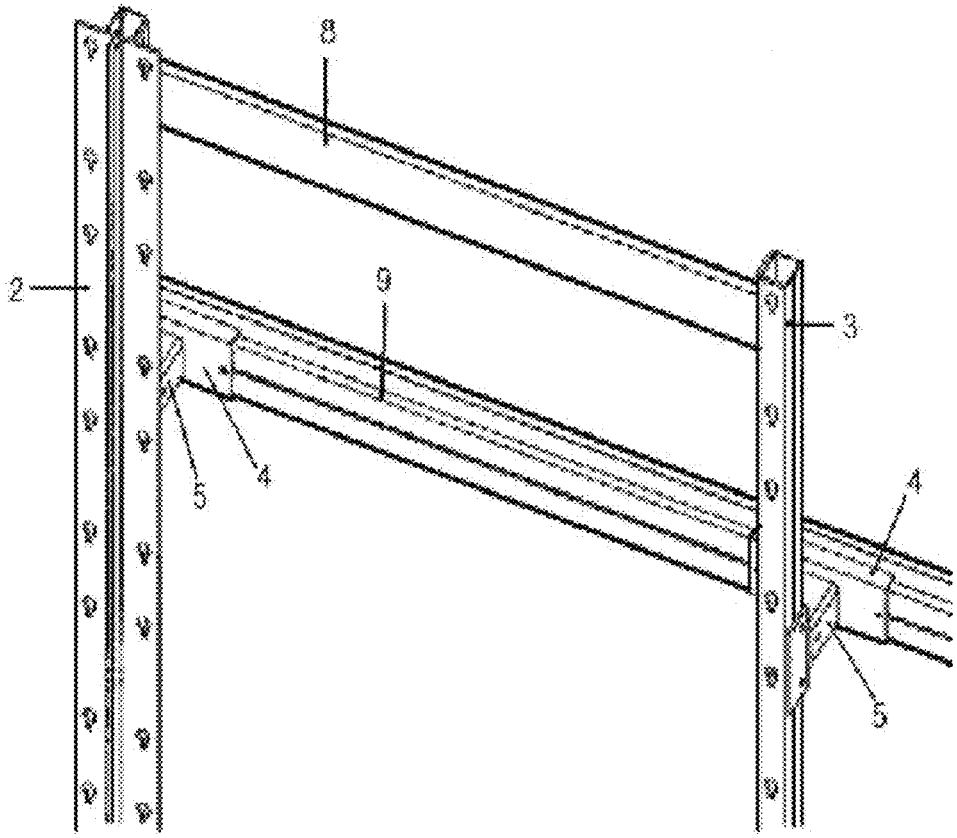
FIG. 11 is an assembled perspective view of the support frame of the wall surface finishing assembly according to the present invention.

FIGS. 10 and 11 show a coupling configuration of the vertical post 2, the middle post 3 and the support frame 8 in detail. Fastening pieces 38 having screw holes 39 are integrated with both ends of the support frame 8 to be fastened to the vertical post 2 and the middle post 30 by screws 20.

In addition, as shown in FIG. 11, the middle post 3 has a substantially rectangular cross-section, and a plurality of panel-hooking fastening holes 30 are formed in the longitudinal direction. Further, the above-mentioned interval adjustment unit is disposed between the middle post 3 and the horizontal track 9 in the same manner.

Figure 12:
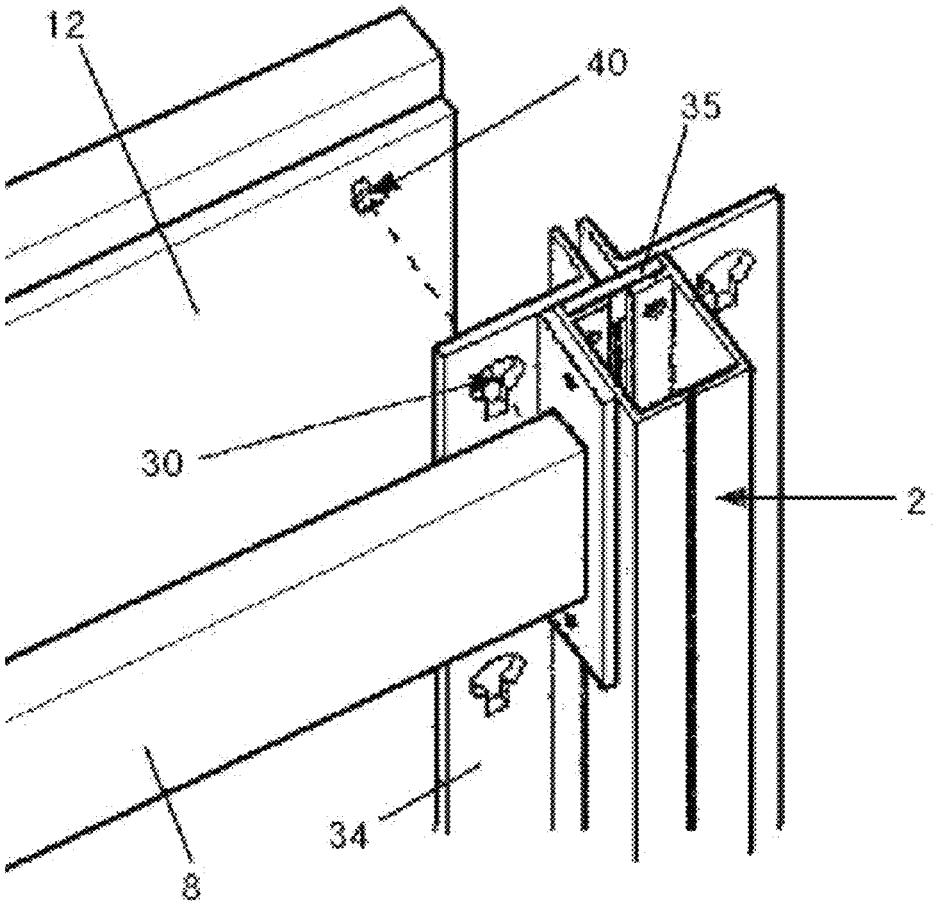
FIG. 12 is an exploded perspective view showing a coupling configuration of an outer panel of the wall surface finishing assembly according to the present invention when seen from a rear surface.

Meanwhile, FIG. 12 shows a configuration in which the outer panel 12 is coupled to the vertical post 2. Here, a hooking screw 40 is fixed to a rear surface of the outer panel 12, and the plurality of fastening holes 30 are formed in the flange 34 of the vertical post 2 in the longitudinal direction. The fastening hole 30 has a keyhole shape, an upper portion of which allows passage of a head section of the hooking screw 40 and a lower portion of which restricts movement thereof. Accordingly, as the head section of the hooking screw 40 is inserted into the fastening hole 30 and moved toward the lower portion to be hooked thereto, the outer panel 12 is coupled to the vertical post 2.

Figure 13:
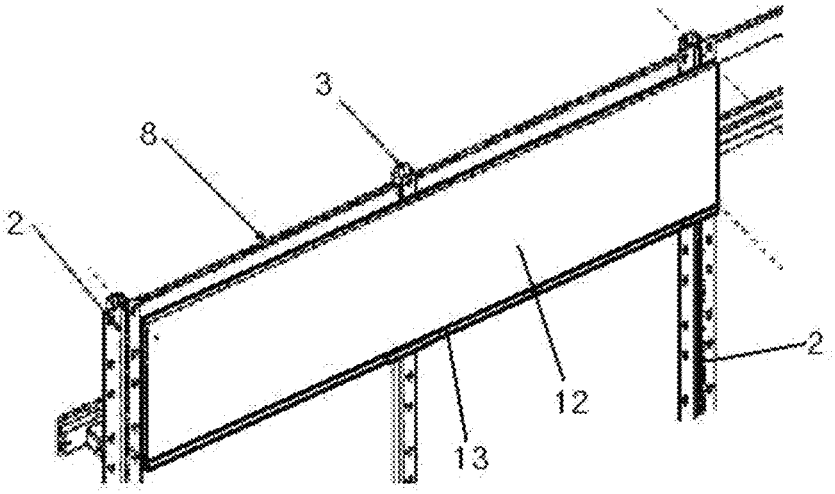
FIG. 13 is an assembled perspective view showing the coupling configuration of the outer panel of the wall surface finishing assembly according to the present invention when seen from a front surface.

As shown in FIG. 13, a slat wall insert 13 is fixed to a lower end of the outer panel 12 by a screw 41 in the lateral direction. The slat wall insert 13 is configured not to expose a space between the vertically neighboring outer panels 12 to the outside, and forms a hooking section 12*a* between an upper end of the outer panel 12 and the slat wall insert 13.

Figure 14:
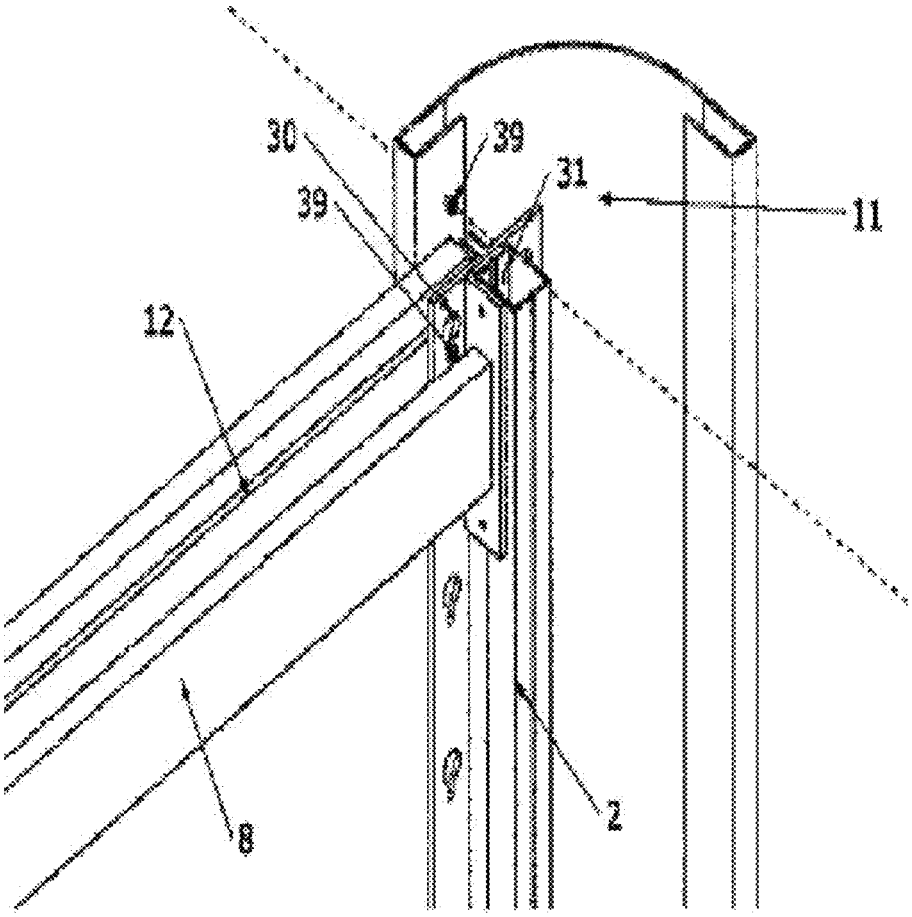
FIG. 14 is an exploded perspective view showing a coupling configuration of the outer panel and a corner member of the wall surface finishing assembly according to the present invention when seen from a rear surface.
Figure 15:
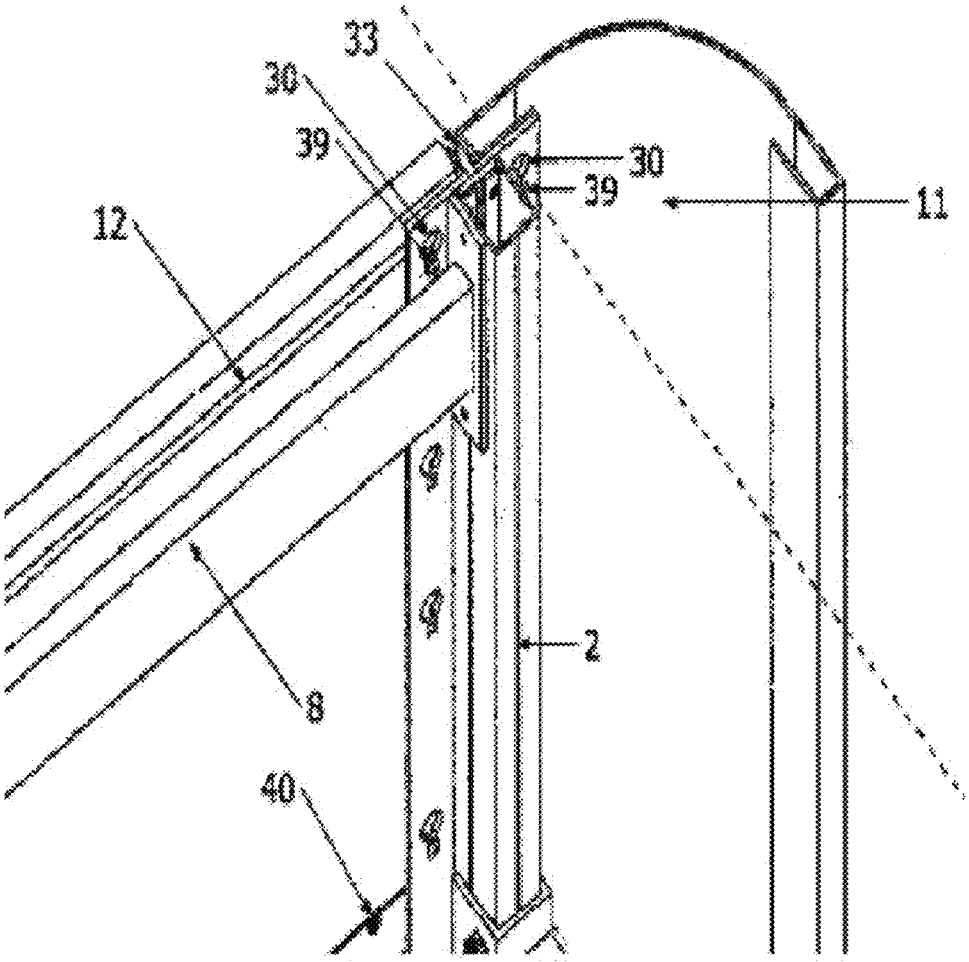
FIG. 15 is an assembled perspective view showing the coupling configuration of the outer panel and the corner member of the wall surface finishing assembly according to the present invention when seen from a front surface.

Meanwhile, FIGS. 14 and 15 show a coupling configuration of a corner member 11. Here, the corner member 11 has an arc-shaped cross-section and is coupled to the fastening hole 30 formed in the same method as the method in which the outer panel is coupled to the flange 34, i.e., formed at the flange 34 of the vertical post 2 by a hooking screw 39.

In the present invention having the above-mentioned configuration, after the horizontal track 9 is fixed to the wall body at a predetermined interval, the hook 21 of the track fastening member 4 is hooked and coupled to the hooking groove 9*a* of the horizontal track 9 in a state in which the vertical post and the interval adjustment unit are previously assembled. Here, a coupling depth of the outer pipe 5 and the inner pipe 6 is adjusted according to the flatness of the wall body 1 to coordinate a vertical state of the vertical post 2 with the flatness with the other neighboring vertical post. When the adjustment is terminated, as the fixing bolt 25 is fastened, movement between the outer pipe 5 and the inner pipe 6 is restricted to form a secure assembly. The insert member 35 and a height adjustment unit 15 may be previously assembled to the vertical post.

Meanwhile, the middle post 3 is coupled between the vertical posts 2 in the same manner at the same time that the vertical posts 2 are fastened, and the support frame 8 is interposed between the upper and lower ends of the vertical post 2 and the middle post 3 to be fastened by the screw 20.

In this state, eventually, when the hooking screw 40 is coupled to a rear surface of the outer panel 12 and the head portion of the hooking screw 40 is inserted into the fastening hole 30 of the flange 34 and then lowered, the head portion of the hooking screw 40 is hooked by a lower end of the fastening hole 30, and the outer panel 12 is fixed to the vertical post 2, completing assembly of the wall body.

Figure 16:
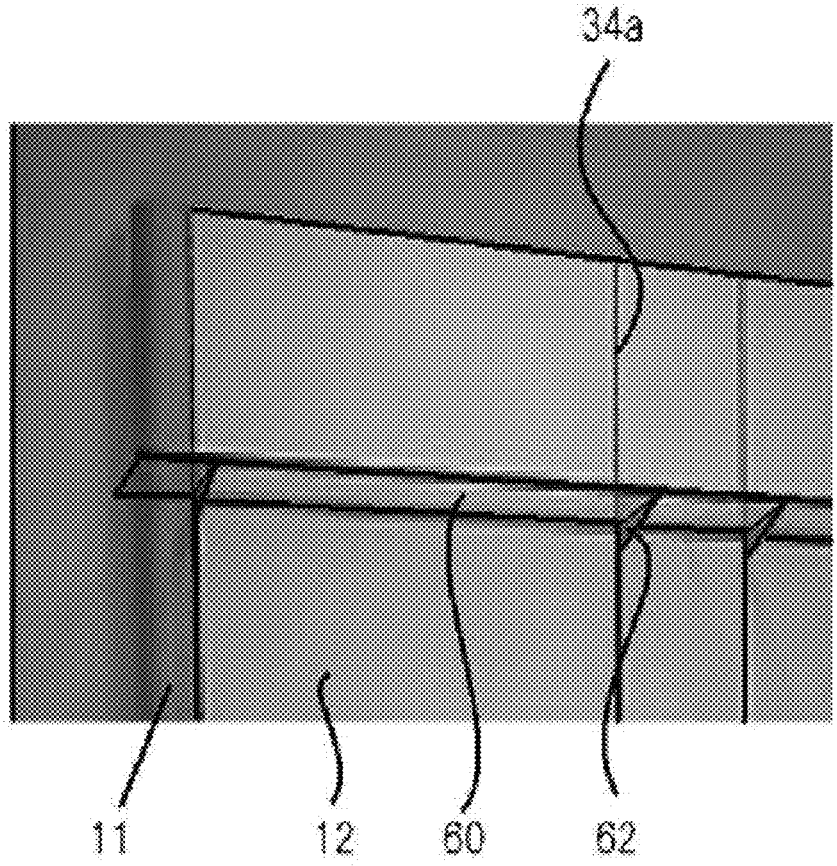
FIG. 16 shows a wall surface finishing assembly according to the present invention is mounted with a shelf mounted thereon.

In this state, as shown in FIG. 16 (a photograph in which a shelf formed of glass is laid is used), rear ends of a pair of support brackets 52 are inserted into the shelf hooking gap 34*a* of the vertical post 2 to be coupled to the shelf hooking slot 36 of the insert member 35, and a shelf 50 is placed thereon to display goods.

Figure 17:
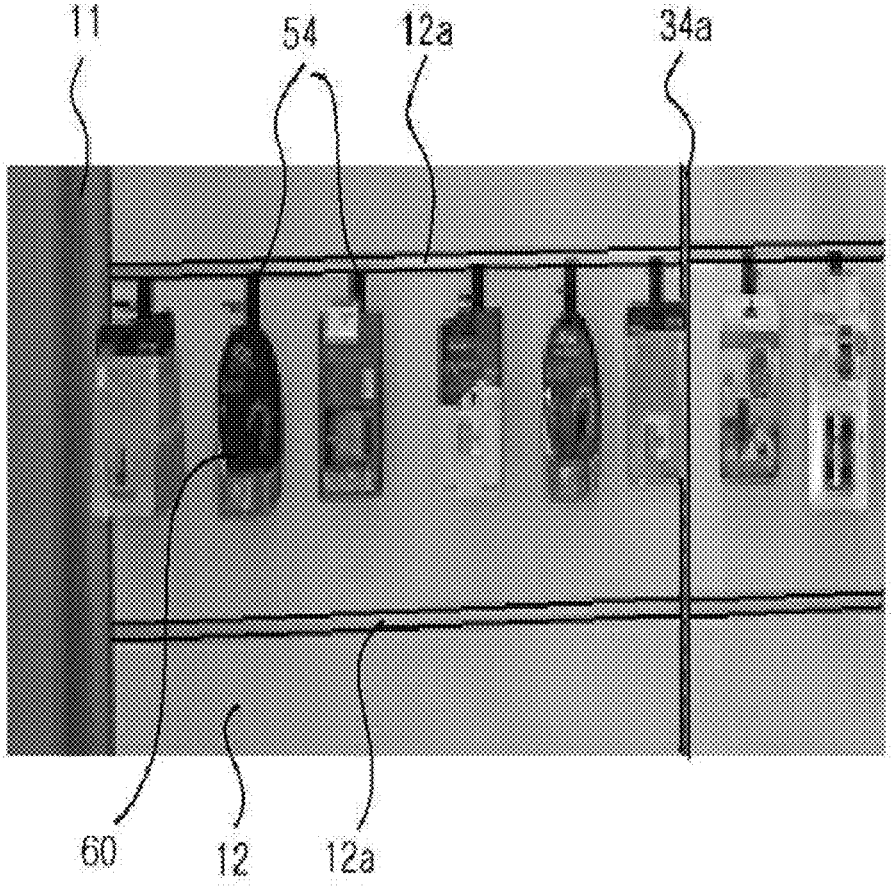
FIG. 17 shows a wall surface finishing assembly according to the present invention without a shelf.

In addition, as shown in FIG. 17, when no shelf need be installed at the hooking section 12*a* formed between the vertically neighboring outer panels 12, a hook 54 may be hooked to display small goods 60 having various shapes.

According to the present invention, since the entire assembly operation can be easily performed and the outer panel can be easily separated from the vertical post when the outer panel is partially damaged, labor of exchange can be reduced.

As can be seen from the foregoing, as the present invention provides the interval adjustment unit in which the horizontal track and the vertical post are provided, the vertical post is coupled to the horizontal track to adjust the interval and the outer panel is fixed to the vertical post, an assembly process is simplified and a general user other than an expert can also easily assembly and construct the wall assembly.

In addition, the wall assembly of the present invention can be constructed even when the flatness of the wall body is bad, and the flatness of the panel after construction can be appropriately maintained, excellently finishing the appearance of the wall surface.

Further, removal and exchange of only a damaged or contaminated outer panel are easy, and maintenance can be easily performed.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A wall assembly for goods display comprising:

a plurality of horizontal tracks disposed at a wall body in a lateral direction;

a plurality of vertical posts disposed in front of the horizontal tracks in a vertical direction, and constituted by a coupling section having a rectangular cross-section disposed in the vertical direction and an open front side, flanges extending from open ends of the coupling section toward both sides, side support walls extending forward from inner side ends of the flanges, a shelf installation gap formed between the side support walls at a predetermined interval, and a support wall protruding from the coupling section to provide a space with the flanges to form an insertion section;

an interval adjustment unit constituted by a post fastening member having an inner pipe provided with one side fixed to a rear surface of the vertical post and the other side extending rearward, a track fastening member having an outer pipe provided with one side fixed to one of the horizontal tracks and the other side coupled to the inner pipe to be length-adjustable, and a fixing bolt fastened to the outer pipe and configured to restrict mutual movement of the inner pipe and the outer pipe at a selected position;

an insert member having a plurality of shelf hooking slots formed in a longitudinal direction and inserted into a fastening hole of one of the vertical posts in the longitudinal direction to be fixed by a screw; and an outer panel coupled to one of the vertical posts.

2. The wall assembly for goods display according to claim 1, wherein a middle post is further installed at an intermediate position between the neighboring vertical posts.

3. The wall assembly for goods display according to claim 2, wherein a height adjustment backing member is installed at lower ends of the vertical post and the middle post.

4. The wall assembly for goods display according to claim 2, wherein a support frame having both ends fixed to the vertical posts and the middle post and configured to define an interval between the vertical posts and the middle post is installed.

5. The wall assembly for goods display according to claim 1, wherein the post fastening member constitutes a fastening section formed in substantially a C shape at a tip thereof and is fixed to a coupling section formed along the entire length of the vertical post by a screw.

6. The wall assembly for goods display according to claim 1, wherein the track fastening member configures a hook formed at a rear end and is fixed to an arbitrary position on a hooking groove formed along the entire length of the horizontal track.

7. The wall assembly for goods display according to claim 1, wherein a slat wall insert is fixed to a lower end of the outer panel in the lateral direction by a screw.

8. The wall assembly for goods display according to claim 1, wherein a hooking screw is fixed to a rear surface of the outer panel, a plurality of fastening holes are formed in the flange of the vertical post in the longitudinal direction, and a head section of the hooking screw is hooked to the fastening hole so that the outer panel is coupled to the vertical post.

* * * * *